US006037317A

United States Patent [19]

Rapisarda et al.

[11] Patent Number: 6,037,317

[45] Date of Patent: Mar. 14, 2000

[54] AQUEOUS CLEANING COMPOSITIONS CONTAINING A 2-ALKYL ALKANOL, $H_2O_2$, AN ANIONIC AND A LOW HLB NONIONIC

[75] Inventors: Dario Rapisarda, Bergamo; Marina Trani, Rome; Elisabetta Russo, Rome; Stefano Scialla, Rome, all of Italy

[73] Assignee: The Procter & Gamble Company, Cincinnati, Ohio

[21] Appl. No.: 08/687,411

[22] PCT Filed: Jan. 31, 1995

[86] PCT No.: PCT/US95/01257

§ 371 Date: Jun. 11, 1997

§ 102(e) Date: Jun. 11, 1997

[87] PCT Pub. No.: WO95/21233

PCT Pub. Date: Aug. 10, 1995

[30] Foreign Application Priority Data

| | | | |
|---|---|---|---|
| Feb. 3, 1994 | [EP] | European Pat. Off. | 94870018 |
| Jun. 8, 1994 | [EP] | European Pat. Off. | 94201634 |

[51] Int. Cl.[7] ..... C11D 3/00; C11D 17/04; C11D 17/00

[52] U.S. Cl. ..... 510/309; 510/317; 510/280; 510/372; 510/421; 510/424

[58] Field of Search ..... 510/372, 394, 510/419, 505, 535, 303, 325, 280, 422, 506, 309, 317, 421, 424

[56] References Cited

U.S. PATENT DOCUMENTS

| | | | |
|---|---|---|---|
| 5,264,143 | 11/1993 | Boutique | 252/95 |
| 5,271,860 | 12/1993 | Schwadtke et al. | 252/96 |
| 5,318,728 | 6/1994 | Surutzidis et al. | 252/548 |
| 5,536,438 | 7/1996 | Scialla et al. | 510/372 |

*Primary Examiner*—Necholus Ogden
*Attorney, Agent, or Firm*—Jason J. Camp; T. David Reed

[57] ABSTRACT

Aqueous cleaning compositions comprising a peroxygen bleach, a hydrophobic surfactant, an anionic surfactant and a 2-alkyl alkanol. The compositions have especially good performance in bleaching hydrophilic stains and the removal of greasy soils.

12 Claims, No Drawings

AQUEOUS CLEANING COMPOSITIONS CONTAINING A 2-ALKYL ALKANOL, $H_2O_2$, AN ANIONIC AND A LOW HLB NONIONIC

TECHNICAL FIELD

The present invention relates to the field of multi-purpose cleaning compositions. Indeed, the present invention relates to the cleaning of different surfaces such as hard-surfaces, carpets or to any laundry applications including stains pretreatment.

BACKGROUND

A wide variety of cleaning compositions have been extensively described in the art. Typically, cleaning compositions can be divided into hard surface cleaning compositions and laundry cleaning compositions. Cleaning compositions of these two types are traditionally very different in formulation and are sold as different products with different marketing concepts. These differences impose on the consumer to have to purchase and use at least two different products. Furthermore, compositions of the two types above, especially hard surface cleaners, can be divided into sub-types. Indeed, many different kinds of hard surface cleaners are available, for instance bathroom cleaners, kitchen cleaners or floor cleaners.

This variety in formulation is rendered necessary by the difference in nature between the soils which can be found on laundry and on various surfaces in kitchens, floors and bathroom. For instance, kitchen soils comprise mainly edible oils, while bathroom soils comprise mainly sebum and soap scum, also limescale; floor soils comprise mainly particulate soils and laundry may have many different soils and stains.

However, there is a trend for the development of cleaning compositions with better performance in several respect, i.e. multi-purpose liquid cleaners which can be satisfactorily used on various surfaces as well as in laundry applications, to clean various soils and stains. Such multi-purpose compositions are, for example, disclosed in European patent application, EP-A-598973. Indeed, this patent application discloses compositions comprising hydrogen peroxide with a fully nonionic system, i.e. at least one nonionic with an HLB above 15, at least one nonionic with an HLB of from 13 to 15, at least one nonionic with an HLB of from 9 to 13 and at least one nonionic with an HLB below 9. This patent application further discloses the use of 2-alkyl alkanols as suds suppressors in said compositions.

But, it has been found that such compositions comprising hydrogen peroxide, a 2-alkyl alkanol and as the surfactant system, a specific nonionic system of at least four nonionic surfactants having different HLB (hydrophilic lipophilic balance) as defined herein before, do not satisfactorily meet consumers needs. Indeed, such compositions based on a fully nonionic surfactant system and comprising a high level of hydrophobic surfactants were found to have poor performance on some kind of stains in laundry application. Although such hydrophobic nonionic surfactants have good grease cutting properties and are particularly effective on greasy soils having hydrophobic character, such as mineral oil and soap scum when used in hard surface cleaning composition, it has been found that when said hydrophobic nonionic surfactants are used in laundry applications bleachable stains are not satisfactorily bleached. The wettability of the fabrics stains is seriously affected by the hydrophobicity of the nonionic system of said compositions, i.e. good contact between hydrogen peroxide and the stains on said fabric is prevented resulting thereby in poor performance on bleachable stain. Also, it has been found that there is a problem associated with the use of such ingredients, i.e. hydrophobic nonionic surfactants and 2-alkyl alkanols, in that they may cause the final product to appear hazy, indicating insolubility and phase separation.

It is thus an object of the present invention to formulate a multi-purpose liquid cleaner which can be satisfactorily used on various surfaces as well as in laundry applications, to clean various soils and stains. It is a further object of the present invention to provide such a composition which is a clear composition in a broad range of temperature, e.g. up to 50° C. The compositions according to the present invention should also be able to perform in a variety of conditions, i.e. in hard and soft water as well as when used neat or diluted. They should also provide satisfactory shine performance and surface safety when used as hard surface cleaners.

In other words, it is an object of the present invention to provide a multi-purpose aqueous composition providing improved laundry performance on bleachable stains and other hydrophilic stains while delivering also outstanding grease cleaning to a variety of surfaces as well as to laundry application.

It has now been found that these objects can be efficiently met by formulating a cleaning composition which comprises hydrogen peroxide, a 2-alkyl alkanol and a specific surfactant system comprising at least a hydrophobic surfactant having an HLB (hydrophilic-lipophilic balance) below 14, preferably a nonionic surfactant, and at least an anionic surfactant, preferably an alkyl sulphate. Indeed, it has been found that by combining these four ingredients a multi-purpose cleaning composition is provided which exhibits a great flexibility in the soils it may clean. It has been found that said composition delivers stronger cleaning performance especially in laundry applications, i.e. said composition gives good performance on bleaching hydrophilic stains as well as on removing greasy stains.

It has also been found that 2-alkyl alkanols strengthen the effect of a given hydrophobic surfactant system in terms of grease cleaning performance. More particularly, for any given cleaning composition comprising a hydrophobic surfactant and which provides a given greasy cleaning performance to a surface treated therewith, adding a 2-alkyl alkanol will improve said greasy cleaning performance. Furthermore, it has surprisingly been found that the use of a 2-alkyl alkanol together with a hydrophobic nonionic surfactant having an HLB below 14 results in a synergetic effect on greasy cleaning.

An advantage of the present compositions is that the suds profile of the compositions herein is particularly suitable for hard surface application where having the right level of suds is critical. Indeed, an advantage of the present invention is that the surface rinsing is facilitated. A further advantage of the present invention is that a very cost effective multi-purpose cleaning composition is provided with excellent performance in hard surface cleaning application, carpet cleaning application and in laundry application.

Cleaning compositions comprising 2-alkyl alkanols have been described in the art. DE 40 21 265 discloses that alcohols branched in 2-position are effective suds suppressors. This patent application discloses compositions comprising a 2-alkyl alkanol together with nonionic ethoxylated alcohols having fatty alcohol chain length of from 13 to 17 and a degree of ethoxylation of from 3 to 7. No compositions comprising bleach are disclosed. Also, this patent application does nowhere disclose the benefits in terms of grease cleaning performance associated with the use of a 2-alkyl alkanol together with a hydrophobic surfactant.

EP-A- 593 841 discloses compositions comprising a surfactant and, as a suds suppressing system, the combination of branched alcohols, e.g. 2-alkyl alkanols, and silicone oils. Different types of surfactants are disclosed including broadly defined anionic, nonionic, cationic and zwitterionic surfactants. This patent application does nowhere disclose that said compositions may further comprise bleaches, let alone hydrogen peroxide. Also, this patent application does nowhere disclose the benefit in terms of grease cleaning associated with the use of a 2-alkyl alkanol in combination with hydrophobic surfactants.

European patent application n° 93870215.6, discloses concentrated cleaning compositions based on short chain surfactants comprising a C6–C10 alkyl chain as their hydrophobic portion. This patent application discloses 2-alkyl alkanols to control suds. This patent application mentions that said short chain surfactants provide stability to the compositions comprising them and that they significantly boost the overall cleaning performance, especially grease cleaning. But, this patent application does not mention that 2-alkyl alkanols boost hydrophobic surfactants ability to clean grease. Also this patent application mentions bleach as an optional ingredient, but nowhere mention hydrogen peroxide.

EP-A-598973, already mentioned hereinbefore, discloses compositions comprising hydrogen peroxide, 2-alkyl alkanol and as surfactant, a fully nonionic system, i.e. at least one nonionic with an HLB above 15, at least one nonionic with an HLB of from 13 to 15, at least one nonionic with an HLB of from 9 to 13 and at least one nonionic with an HLB below 9. However, it is mentioned in this patent application that the compositions disclosed therein do not require the use of anionic surfactant system and that said compositions are preferably free of anionic surfactants. Also, this patent application does nowhere disclose the benefit in terms of grease cleaning associated with the use of a 2-alkyl alkanol in combination with hydrophobic nonionic surfactants.

SUMMARY OF THE INVENTION

The present invention encompasses an aqueous cleaning composition comprising hydrogen peroxide, or a source thereof, a 2-alkyl alkanol or mixtures thereof, a hydrophobic surfactant having an HLB below 14, or mixtures thereof, and an anionic surfactant.

The present invention encompasses the use, in an aqueous cleaning composition, of a 2-alkyl alkanol together with a hydrophobic surfactant having an HLB below 14, or mixtures thereof, to improve the greasy cleaning performance of said composition.

DETAILED DESCRIPTION OF THE INVENTION

The compositions according to the present invention are aqueous cleaning compositions. Said compositions comprise hydrogen peroxide, or a source thereof, a 2-alkyl alkanol, or mixtures thereof, a hydrophobic surfactant having an HLB below 14 and an anionic surfactant. The compositions of the present invention are particularly efficient in cleaning a variety of different soils, and significant cooperation has been observed between the four ingredients. Indeed, the present compositions clean a variety of soils, from particulate to non-particulate soils, from hydrophilic to hydrophobic soils and are particularly suitable for laundry application on both hydrophobic and hydrophilic fabric.

As a first essential ingredient, the compositions of the present invention comprise hydrogen peroxide, or a water soluble source thereof. In the preferred embodiment, the compositions according to the present invention comprise hydrogen peroxide. Typically, the compositions suitable to be used herein comprise from 0.5% to 20% by weight of the total composition of hydrogen peroxide, or a source thereof, preferably from 2% to 15% and most preferably from 3% to 10%. Indeed, the presence of hydrogen peroxide provides strong cleaning benefits which are particularly noticeable in laundry applications. Furthermore, the combination of the present invention, i.e. surfactants together with 2-alkyl alkanols, for use in cleaning compositions is remarkably compatible with hydrogen peroxide in that good hydrogen peroxide storage stability was observed for said compositions, even in the absence of hydrogen peroxide stabilizers.

As a second essential ingredient, the compositions of the present invention comprise a 2-alkyl alkanol, or mixtures thereof. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the a position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol).

Typically, the compositions suitable to be used herein comprise from 0.05% to 2% by weight of the total composition of a 2-alkyl alkanol, or mixtures thereof, preferably from 0.1% to 1.5% and most preferably from 0.2% to 0.8%.

As a third essential ingredient, the compositions of the present invention comprise a hydrophobic surfactant having an HLB (hydrophilic-lipophilic balance) below 14, or mixtures thereof. In the compositions according to the present invention, said hydrophobic surfactant and said 2-alkyl alkanol act together, particularly on greasy soils such as the kitchen dirt soils and the bathtub soils. It is thus possible to use low total levels of said hydrophobic surfactant, or mixtures thereof. The compositions according to the present invention comprise from 0.1% to 15% by weight of the total composition of said hydrophobic surfactant, or mixtures thereof, preferably from 0.3% to 10% and more preferably from 0.4% to 6%.

Particularly suitable to be used herein are the hydrophobic nonionic surfactants having an HLB below 14, preferably nonionic surfactants having an HLB below 12, more preferably below 11.5, and most preferably below 10. Yet the highly preferred nonionic surfactants according to the present invention have an HLB below 9. Those hydrophobic nonionic surfactants have been found to provide good grease cutting properties.

Suitable hydrophobic nonionic surfactants to be used herein are fatty alcohol ethoxylates and/or propoxylates which are commercially available with a variety of fatty alcohol chain lengths and a variety of ethoxylation degrees. Indeed, the HLB values of such alkoxylated nonionic surfactants depend essentially on the chain length of the fatty alcohol, the nature of the alkoxylation and the degree of alkoxylation. Hydrophobic surfactants tend to have a low degree of alkoxylation and a long chain fatty alcohol. Surfactants catalogs are available which list a number of surfactants, including nonionics, together with their respective HLB values.

Suitable chemical processes for preparing the hydrophobic nonionic surfactants for use herein include condensation of corresponding alcohols with alkylene oxide, in the desired proportions. Such processes are well known to the man skilled in the art and have been extensively described in the art. As an alternative, a great variety of alkoxylated alcohols suitable for use herein is commercially available from various suppliers.

Preferred hydrophobic nonionic surfactants to be used in the compositions according to the present invention are surfactants having an HLB below 14 and being according to the formula $RO-(C_2H_4O)_n(C_3H_6O)_mH$, wherein R is a $C_6$ to $C_{22}$ alkyl chain or a $C_6$ to $C_{28}$ alkyl benzene chain, and wherein n+m is from 0 to 20 and n is from 0 to 15 and m is from 0 to 20, preferably n+m is from 1 to 15 and, n and m are from 0.5 to 15, more preferably n+m is from 1 to 10 and, n and m are from 0 to 10. The preferred R chains for use herein are the $C_8$ to $C_{22}$ alkyl chains. Accordingly suitable hydrophobic nonionic surfactants for use herein are Dobanol® 91-2.5 (HLB=8.1; R is a mixture of C9 and $C_{11}$ alkyl chains, n is 2.5 and m is 0), or Lutensol® TO3 (HLB=8; R is a $C_{13}$ alkyl chains, n is 3 and m is 0), or Lutensol$^R$ AO3 (HLB=8; R is a mixture of $C_{13}$ and $C_{15}$ alkyl chains, n is 3 and m is 0), or Tergitol$^R$ 25L3 (HLB=7.7; R is in the range of $C_{12}$ to $C_{15}$ alkyl chain length, n is 3 and m is 0), or Dobanol$^R$ 23-3 (HLB=8.1; R is a mixture of $C_{12}$ and $C_{13}$ alkyl chains, n is 3 and m is 0), or Dobanol$^R$ 23-2 (HLB=6.2; R is a mixture of $C_{12}$ and $C_{13}$ alkyl chains, n is 2 and m is 0), or Dobanol$^R$ 23-6.5 (HLB=11.9; R is a mixture of $C_{12}$ and $C_{13}$ alkyl chains, n is 6.5 and m is 0), or Dobanol$^R$ 25-7 (HLB=12; R is a mixture of $C_{12}$ and $C_{15}$ alkyl chains, n is 7 and m is 0), or Dobanol$^R$ 91-5 (HLB=11.6; R is a mixture of $C_9$ and $C_{11}$ alkyl chains, n is 5 and m is 0), or Dobanol$^R$ 91-6 (HLB=12.5; R is a mixture of $C_9$ and $C_{11}$ alkyl chains, n is 6 and m is 0), or Dobanol$^R$ 91-8 (HLB=13.7; R is a mixture of $C_9$ and $C_{11}$ alkyl chains, n is 8 and m is 0), or mixtures thereof. Preferred herein are Dobanol$^R$ 91-2.5, or Lutensol$^R$ TO3, or Lutensol$^R$ A03, or Tergitol$^R$ 25L3, or Dobanol$^R$ 23-3, or Dobanol$^R$ 23-2, or mixtures thereof. These Dobanol$^R$ surfactants are commercially available from SHELL. These Lutensol$^R$ surfactants are commercially available from BASF and these Tergitol$^R$ surfactants are commercially available from UNION CARBIDE.

As a fourth essential ingredient, the compositions of the present invention comprise an anionic surfactant, or mixtures thereof. Said anionic surfactants which are hydrophilic compounds act together with the hydrophobic surfactants such as to counterbalance the negative effect of hydrophobic surfactants. Said anionic surfactants act as wetting agent, i.e. in laundry application they wet the stains on the fabrics, especially on hydrophilic fabrics, and thus help hydrogen peroxide to perform its bleaching action thereby contributing to improved laundry performance on bleachable stains. Furthermore, the anionic surfactants of the present invention allow to obtain clear compositions even when said compositions comprise hydrophobic ingredients such as 2-alkyl alkanols and hydrophobic surfactants. The compositions according to the present invention comprise from 0.1% to 20% by weight of the total composition of said anionic surfactant, or mixtures thereof, preferably from 0.2% to 10% and more preferably from 0.5% to 8% .

Particularly suitable to be used in the present invention are sulfonate and sulfate surfactants. The like anionic surfactants are well-known in the art and have found wide application in commercial detergents. These anionic surfactants include the C8–C22 alkyl benzene sulfonates (LAS), the C8–C22 alkyl sulfates (AS), unsaturated sulfates such as oleyl sulfate, the C10–C18 alkyl alkoxy sulfates (AES) and the C10–C18 alkyl alkoxy carboxylates. The neutralizing cation for the anionic synthetic sulfonates and/or sulfates is represented by conventional cations which are widely used in detergent technology such as sodium, potassium or alkanolammonium. Preferred herein are the alkyl sulphate, especially coconut alkyl sulphate having from 6 to 18 carbon atoms in the alkyl chain, preferably from 8 to 15, or mixtures thereof.

The compositions suitable to use in the present invention may further comprise other nonionic and/or anionic surfactants apart from the ones described herein above as well as surfactants of other different classes such as cationic, zwitterionic or amphotheric surfactants.

The compositions suitable to use in the present invention are aqueous liquid cleaning compositions. Said aqueous compositions have a pH as is of from 1 to 9, preferably from 3 to 6 and more preferably from 3 to 4. The pH of the compositions can be adjusted by using organic or inorganic acids, or alkalinizing agents.

The compositions suitable for use in the present invention may further comprise a variety of optional ingredients such as builders, stabilizers, chelants, soil suspenders, dye transfer agents, solvents, brighteners, perfumes and dyes.

The compositions suitable to be used according to the present invention can be used as a household cleaner in the bathroom or in the kitchen, and can also be used as a laundry detergent or as a laundry detergent booster or as laundry prewash treatment composition. When used as hard surface cleaners, such compositions are easy to rinse and provide good shine characteristics on the cleaned surfaces. Also such compositions are also particularly effective as carpet cleaners. If used as carpet cleaners, such compositions are advantageously dispensed with spray dispenser and left to act on said carpets.

Apart from providing the compositions described herein before the present invention is also based on the finding that, in aqueous cleaning compositions, using a 2-alkyl alkanol together with a hydrophobic surfactant having an HLB below 14 will improve the greasy cleaning of said composition.

By "improve the greasy cleaning" it is to be understood herein that the greasy cleaning achieved by using a 2-alkyl alkanol together with a hydrophobic surfactant having an HLB below 14 in a given composition is improved as compared to the greasy cleaning obtained with the same composition comprising either only one of said two additional compounds or none of them. Also it has been found that a synergetic effect on grease cleaning performance is associated with the use of a 2-alkyl alkanol with hydrophobic nonionic surfactants in aqueous cleaning compositions. The grease cleaning performance of a composition may be evaluated by different grease test methods such as the GSS (grease soap scum soil) test method used hereinafter in the examples.

An advantage associated with the present invention is that due to the use of a 2-alkyl alkanol a good suds profile is obtained. Indeed, the present invention allows to avoid too much foaming which is likely to be detrimental to shine, and makes rinsing troublesome for the consumer. In other words, it is possible to have with the present invention the desired suds profile without the need to add any other suds suppressing ingredient, such as silicone-based suds suppressers which are detrimental to the stability of hydrogen peroxide and the aesthetics of the composition.

The present invention will be further illustrated by the following examples.

A) Experimental Data on the Benefits Associated with the Compositions of the Present Invention The following compositions were made by mixing the listed ingredients in the listed proportions (weight % unless otherwise specified).

| Compositions | I | Il | III | IV | V | VI |
|---|---|---|---|---|---|---|
| Dobanol ® 91-10 | — | — | 1.6 | 1.6 | 1.6 | 1.6 |
| Alkylsulphate | — | 1.5 | – | 1.5 | 1.5 | 1.5 |
| Dobanol ® 23-3 | – | — | 1.1 | 1.1 | 1.1 | — |
| $H_2O_2$ | 7.0 | 7.0 | 7.0 | 7.0 | 7.0 | 7.0 |
| 2-Butyl Octanol | — | – | 0.4 | 0.4 | — | 1.1 |
| Water and minors | | | up to 100% | | | |
| H2SO4 up to pH 4 | | | | | | |

Dobanol® 91-10 is a nonionic surfactant having an HLB of 14.7. Dobanol® 23-3 is a nonionic surfactant having an HLB of 8.1 and alkyl sulphate is coconut alkylsulphate commercially available from Marchon under the trade name Empicol 0298F®.

Composition I comprises only hydrogen peroxide and is taken as a reference for the grease cleaning in hard surface application and for the bleachable performance in laundry application. Composition II comprises hydrogen peroxide and an alkyl sulphate. Composition III is representative of the compositions of the prior art and comprises as the surfactants, a nonionic system. Composition IV is representative of the present invention, i.e. it comprises 2-butyl octanol together with a hydrophobic nonionic surfactant, Dobanol® 23-3, hydrogen peroxide and an alkyl sulphate (coconut alkylsulphate). Composition V differs from composition IV in that composition V does not comprise 2-butyl octanol. Composition VI differs from composition IV in that composition VI does not comprise Dobanol® 23-3. Actually, all these compositions apart from composition IV are taken as a reference for demonstrating that the benefits associated with a composition according to the present invention are linked to the different ingredients which act together.

The Following Tests were Carried Out

A GSS (greasy soap scum soil) test method was carried out with the compositions mentioned herein above. This GSS test method was carried out using a synthetic soil representative of typical hard surface household (bathroom) soil. The test-soil (GSS soil) was prepared by mixing isopropyl alcohol, calcium stearate powder, a mixture of soils including inorganic and organic compounds representing average house soils and a mixture of greasy soils namely natural greasy compounds. This test-soil was applied on an enamel-coated metal plate (cleaned with a detergent and then with alcohol) with a paint roller, and the plates are baked at 130° C. for 30 minutes. After 24 hours they can be used for the test. This test is evaluated in a Gardner straight-line scrub machine.

Composition 1 was taken as a reference and compared to compositions II to VI to evaluate their grease cleaning performance. A composition rated+is significantly better versus the reference composition (I). A composition rated++ is significantly better than a composition rated+and a composition rated+++is significantly better than a composition rated++. Between compositions rated with the same points differences are not statistically significant. These results are obtained on a eight replicates test.

A laundry test was performed on white cotton fabric stained with tea. The stain was pretreated with 4 ml. of the compositions mentioned herein before and the fabrics were washed at 25° C.

A suds test was conducted with a cylinder suds machine. 500 ml. of a solution containing 12.5 gr. of a composition herein before mentioned was spinned for 10 minutes. Such solutions have been prepared with each of the compositions mentioned herein before. Water hardness was 18 grain/gallon. The number is an index that takes into account the suds (in cm) of the corresponding composition and the speed at which it collapses. The suds is measured when the cylinders are stopped, after 5 minutes and after 30 minutes. The maximum given to a composition is number 10 and corresponds to a composition for which the cylinders are full of suds at the three different measurement times.

Results were as Follows

| Compositions | I | II | III | IV | V | VI |
|---|---|---|---|---|---|---|
| Laundry application | Ref. | = | – | = | = | = |
| Hydrophilic stain (tea) | | | | | | |
| Hard surfaces application | | | | | | |
| GSS test | Ref. | + | +++ | +++ | ++ | ++ |
| Appearance | clear | clear | hazy | clear | clear | hazy |
| Suds | 0 | 7 | 2 | 3 | 9 | 3 |

The above results clearly show the benefits of a composition according to the present invention (composition IV). Indeed, the results show that the compositions of the present invention comprising as the surfactant system both a hydrophobic surfactant having an HLB below 14 and an anionic surfactant are better in terms of laundry performance while maintaining good grease cleaning performance when used as hard surface cleaners as compared to compositions without said anionic surfactant (see composition IV as compared to composition III representative of the prior art). Said results further show that there is a beneficial contribution of alkyl sulfate on the aspect of the finished composition, i.e. the alkyl sulphate gives to the composition crystal clear aspect.

Said results also show the role of 2 butyl octanol not only as a booster of hydrophobic surfactants but also as a suds suppressing agent (see, for example, compositions V or II versus composition IV).

As for the synergetic effect associated with the use of 2 butyl octanol together with a hydrophobic nonionic surfactant, (DOBANOL 23.3®) in cleaning detergent in terms of greasy cleaning performance, although obtained with composition IV as compared to compositions V or VI, this is further demonstrated in the following experimental data.

B) Experimental Data on the Synergism Between Hydrophobic Nonionic Surfactants and 2-Alkyl Alkanol on Grease Cleaning The following compositions were made by mixing the listed ingredients in the listed proportions (weight % unless otherwise specified).

| Compositions | I | II | III |
|---|---|---|---|
| Lutensol ® AO 30 | 0.75 | 0.75 | 0.75 |
| Dobanol ® 91-10 | 2.60 | 2.60 | 2.60 |
| Dobanol ® 23-6.5 | 0.90 | 0.90 | 0.90 |
| Dobanol ® 23-3 | 1.00 | 1.75 | — |
| $H_2O_2$ | 7.00 | 7.00 | 7.00 |
| $H_2SO_4$ up to pH | 4.00 | 4.00 | 4.00 |
| 2-Butyl Octanol | 0.75 | — | 1.75 |
| Water and minors | | up to 100% | |

Lutensol® AO 30 is a nonionic surfactant having an HLB of 17, Dobanol® 91-10 is a nonionic surfactant having an HLB of 14.7, Dobanol® 23-6.5 is a nonionic surfactant having a HLB of 11.9, and Dobanol® 23-3 is a nonionic surfactant having an HLB of 8.1.

Composition I is representative of the present invention, i.e. it comprises 2-butyl octanol together with a hydrophobic surfactant having an HLB below 14, Dobanol® 23-3. Composition II differs from composition I in that composition II does not comprise 2-butyl octanol. Composition III differs from composition I in that composition III does not comprise Dobanol® 23-3. Compositions II and III are taken as reference.

A GSS (greasy soap scum soil) test method was carried out with the compositions mentioned herein above.

This GSS test method was carried out using a synthetic soil representative of typical hard surface household (bathroom) soil. The test-soil (GSS soil) was prepared by mixing isopropyl alcohol, calcium stearate powder, a mixture of soils including inorganic and organic compounds and representing average house soils and a mixture of greasy soils namely natural greasy compounds. This test-soil was applied on an enamel-coated metal plate (cleaned with a detergent and then with alcohol) with a paint roller, and the plates are baked at 130° C. for 30 minutes. After 24 hours they can be used for the test. This test is evaluated in a Gardner straight-line scrub machine.

The results are given in number of strokes a given composition needs to clean a standard soiled (GSS soil) plate. The lower the number of strokes needed the more efficient in terms of cleaning is the composition used to clean the dirt from the test plates.

Results were as follows: the indicated figures represent the number of strokes, as defined hereinabove.

| Compositions | No of strokes |
|---|---|
| Composition I | 79.5 |
| Composition II | 100.0 |
| Composition III | 104.5 |

The above results clearly show that there is a synergetic effect associated with the use of a 2-alkyl alkanol (2-butyl octanol) together with a hydrophobic nonionic surfactant having an HLB below 14 (Dobanol® 23-3) in cleaning detergent in terms of greasy cleaning performance.

EXAMPLES

Following compositions were made by mixing the listed ingredients in the listed proportions (weight % unless otherwise specified).

| Compositions | I | II | III | IV |
|---|---|---|---|---|
| $H_2O_2$ | 7.0 | 7.0 | 7.0 | 7.0 |
| Alkylsulphate (1) | 1.2 | — | 1.2 | — |
| Dobanol ® 91-8 | — | — | 1.6 | — |
| Dobanol ® 91-10 | 1.6 | 1.6 | — | 1.6 |
| Lial alkylsulphate (2) | — | 1.5 | — | 1.5 |
| Dobanol ® 23-3 | 1.1 | 1.1 | — | 1.1 |
| Lutensol ® TO 3 | — | — | 1.1 | — |
| 2-Butyl Octanol | 0.5 | 0.5 | 0.6 | 0.2 |
| Water and minors (dye) | | up to 100% | | |
| $H_2SO_4$ up to pH 4 | | | | |

(1) is a coconut alkylsulphate commercially available from Marchon under the trade name Empicol 0298F® and (2) is a branched alkylsulphate commercially available from Marchon under the trade name Empicol 8221®. Dobanol® 23-3 is a nonionic surfactant having an HLB of 8.1 and Lutensol® TO 3 is a nonionic surfactant having an HLB of 8.

The compositions in the examples are according to the present invention, i.e. they exhibit good greasy cleaning on various soils such as kitchen dirt soils, bathtub soils as well as excellent laundry performance. Furthermore, the stability of hydrogen peroxide was monitored and proved satisfactory at 50° C. for two weeks. Also, the compositions in the examples are crystal clear compositions in a broad range of temperature, e.g. up to 50° C., said compositions further provide satisfactory shine performance and surface safety when used as hard surface cleaners. Also, these compositions are able to perform in a variety of conditions, i.e. in hard and soft water.

What is claimed is:

1. An aqueous cleaning composition having a pH of 3 to 4 comprising 2 to 15% of a hydrogen peroxide, or a source thereof, 0.1 to 1.5% of a 2-alkyl alkanol, 0.3 to 10 % of a mixtures thereof, a hydrophobic nonionic surfactant which is a fatty alcohol ethoxylate and/or propoxylate having an HLB below 10 or mixtures thereof, 0.1 to 20% of and an anionic surfactant.

2. The use, in a pH 3 to 4 aqueous cleaning having a pH of 3 to 4 composition, of from 0.1 to 1.5% of a 2-alkyl alkanol, or mixtures thereof, together with a hydrophobic nonionic surfactant which is a fatty alcohol ethoxylate or propoxylate having an HLB below 10, or mixtures thereof, to improve the greasy cleaning performance of said composition, comprising the step of incorporating said 2-alkyl alkanol or mixtures thereof into said aqueous composition comprising said hydrophobic surfactant or mixtures thereof.

3. A composition according to claim 1 wherein said 2-alkyl alkanol has an alkyl chain comprising from 6 to 16 carbon atoms, and a terminal hydroxy group, said alkyl chain being substituted in the α position by an alkyl chain comprising from 1 to 10 carbon atoms.

4. A composition according to claim 1 wherein said 2-alkyl alkanol is 2-butyl octanol or 2-hexyl decanol, or mixtures thereof.

5. A composition according to claim 1 wherein said composition comprises from 3% to 10% by weight of hydrogen peroxide.

6. A composition according to claim 1 wherein said composition comprises from 0.1% to 20% of an anionic surfactant and wherein said anionic surfactant is an alkyl sulphate having from 6 to 18 carbon atom in its alkyl chain.

7. A composition according to claim 1 wherein said composition comprises from about 0.4% to about 6% by weight of the total composition of said nonionic surfactant.

8. A composition according to claim 3 wherein said 2-alkyl alkanol has an alkyl chain comprising from about 8 to about 12 carbon atoms and a terminal hydroxy group, said alkyl chain being substituted in the α position by an alkyl chain comprising from about 2 to about 8 carbon atoms.

9. A composition according to claim 8 wherein said 2-alkyl alkanol has an alkyl chain comprising from about 6 to about 16 carbon atoms and a terminal hydroxy group, said alkyl chain being substituted in the α position by an alkyl chain comprising from about 3 to about 6 carbon atoms.

10. A composition according to claim 1 wherein said composition comprises from about 0.2% to about 0.8% by weight of the total composition of said 2-alkyl alkanol, or mixtures thereof.

11. A composition according to claim 6 wherein said anionic surfactant is an alkyl sulphate having from 8 to 15 carbon atom in its alkyl chain.

12. The method according to claim 2 wherein said 2-alkyl alkanol has an alkyl chain comprising from about 6 to about 16 carbon atoms, and a terminal hydroxy group, said alkyl chain being substituted in the $\alpha$ position by an alkyl chain comprising from about 1 to about 10 carbon atoms.

* * * * *